US010793238B2

(12) United States Patent
Betz et al.

(10) Patent No.: US 10,793,238 B2
(45) Date of Patent: Oct. 6, 2020

(54) PERSONAL FLOTATION DEVICE

(71) Applicant: FT Systems, Inc., Troy, NY (US)

(72) Inventors: Jeffrey R. Betz, Cohoes, NY (US); Michael J. Lobsinger, Cohoes, NY (US)

(73) Assignee: FT Systems, Inc., Troy, NY (US)

( * ) Notice: Subject to any disclaimer, the term of this patent is extended or adjusted under 35 U.S.C. 154(b) by 0 days.

(21) Appl. No.: 15/611,967

(22) Filed: Jun. 2, 2017

(65) Prior Publication Data

US 2017/0267322 A1 Sep. 21, 2017

Related U.S. Application Data

(63) Continuation of application No. 12/174,452, filed on Jul. 16, 2008, now Pat. No. 9,789,940.

(51) Int. Cl.
*B63C 9/125* (2006.01)
*B63C 9/11* (2006.01)

(52) U.S. Cl.
CPC ..... *B63C 9/1255* (2013.01); *B63C 9/11* (2013.01)

(58) Field of Classification Search
CPC ..... A41D 13/0125; B63C 9/081; B63C 9/115; B63C 9/1255; B63C 9/11; B63C 9/125
See application file for complete search history.

(56) References Cited

U.S. PATENT DOCUMENTS 682,160 A * 9/1901 Anderson ..... B63C 9/1255 441/114
1,504,249 A 8/1924 Klein
1,723,402 A * 8/1929 Browdy ..... A41D 7/003 441/102
1,803,898 A 5/1931 Diamond
1,868,210 A 7/1932 Lehmann
2,223,880 A * 12/1940 Ardern ..... B63C 9/1055 441/112
2,425,206 A 8/1947 Ripley
(Continued)

FOREIGN PATENT DOCUMENTS

FR 444519 A * 10/1912 ..... B63C 9/1255
FR 454722 A * 7/1913 ..... B41B 11/18
(Continued)

OTHER PUBLICATIONS

International Search Report and Written Opinion for International Application No. PCT/US2009/004067, dated Feb. 26, 2010, 12 pages.
(Continued)

*Primary Examiner* — Ajay Vasudeva
(74) *Attorney, Agent, or Firm* — Wolf, Greenfield & Sacks, P.C.

(57) ABSTRACT

A personal flotation device may include a chest portion, an abdominal portion, and a connecting portion positioned between the chest portion and the abdominal portion. The width of the connecting portion may be smaller than the width of both the chest portion and the abdominal portion. The connecting portion may extend only from a center region of the chest portion. The chest portion, abdominal portion and connecting portion may be arranged to together form an approximately I-shaped portion. The personal flotation device may be secured to a garment.

15 Claims, 8 Drawing Sheets

(56) References Cited

U.S. PATENT DOCUMENTS

| | | | | | |
|---|---|---|---|---|---|
| 2,500,661 | A | * | 3/1950 | Chillemi | B63C 9/1255 2/67 |
| 2,607,934 | A | * | 8/1952 | Bailhe | A41D 13/0125 2/93 |
| 3,094,724 | A | * | 6/1963 | Lerner | B63C 9/115 441/118 |
| 3,134,993 | A | | 6/1964 | McCoy | |
| 3,199,128 | A | | 8/1965 | Nojd | |
| 3,266,070 | A | | 8/1966 | O'Link | |
| 3,747,141 | A | | 7/1973 | Crockford | |
| 3,931,657 | A | | 1/1976 | Jones | |
| 4,097,947 | A | | 7/1978 | Kiefer | |
| 5,184,968 | A | | 2/1993 | Michalochick et al. | |
| 5,746,632 | A | | 5/1998 | Theberge | |
| 5,759,076 | A | * | 6/1998 | Bateman | B63C 9/1255 441/115 |
| 6,766,535 | B2 | | 7/2004 | Duhamell et al. | |
| 7,028,341 | B2 | | 4/2006 | Ikenaga et al. | |
| 7,059,924 | B2 | | 6/2006 | Farmer et al. | |
| D528,181 | S | | 9/2006 | Hilts | |
| 7,150,668 | B2 | | 12/2006 | Kemp | |
| 9,789,940 | B2 | * | 10/2017 | Betz | B63C 9/11 |
| 2005/0042956 | A1 | | 2/2005 | Hodara | |
| 2005/0142962 | A1 | | 6/2005 | Tsitas | |

FOREIGN PATENT DOCUMENTS

| | | | | | |
|---|---|---|---|---|---|
| FR | 916416 | A | | 5/1946 | |
| FR | 916416 | A | * | 12/1946 | B63C 9/1255 |
| FR | 969928 | A | * | 12/1950 | B63C 9/1255 |
| FR | 1024140 | A | | 3/1953 | |
| GB | 191503029 | A | * | 6/1915 | B63C 9/1255 |
| GB | 461295 | A | * | 2/1937 | B63C 9/1255 |
| GB | 2250482 | | | 10/1992 | |
| GB | 2261590 | | | 5/1993 | |
| JP | 07-232697 | | | 5/1995 | |
| JP | 11-124087 | | | 11/1999 | |
| JP | 02-187594 | | | 2/2002 | |
| JP | 05-519656 | | | 7/2005 | |
| WO | WO 03/031257 | A1 | | 4/2003 | |
| WO | WO 2005/039971 | A1 | | 5/2005 | |

OTHER PUBLICATIONS

Extended European Search Report for European Application No. 09798279.7, dated Nov. 6, 2013, 11 pages.

Intention to Grant for European Application No. 09798279.7, dated Mar. 3, 2016, 39 pages.

PaddleAir Inflatable Rash Guard (Paddling Aid), Wetsand.com, printed Jun. 23, 2008, 1 page.

* cited by examiner

PERSONAL FLOTATION DEVICE

CROSS REFERENCE TO RELATED APPLICATION

This application is a continuation of U.S. application Ser. No. 12/174,452, filed Jul. 16, 2008, which is hereby incorporated by reference in its entirety.

FIELD OF INVENTION

The present invention relates to a personal flotation device.

BACKGROUND OF INVENTION

Personal flotation devices typically include either an inherently buoyant material, an inflatable chamber, or a combination of an inherently buoyant material and an inflatable chamber to provide buoyancy to assist in keeping a person afloat.

Some known personal flotation devices are substantially U-shaped, where the center of the U-shape is configured to extend around the back of the neck of a wearer and each end of the U-shape is configured to extend around the wearer's shoulders and onto the chest of the wearer.

One example of an inflatable personal flotation device is described in Applicant's patent, U.S. Pat. No. 7,059,924, which is hereby incorporated by reference in its entirety.

SUMMARY OF INVENTION

In one illustrative embodiment, a personal flotation device includes a chest portion having a top region and a bottom region, an abdominal portion, and a connecting portion positioned between the bottom region of the chest portion and the abdominal portion. The connecting portion extends only from a center region of the chest portion, wherein the width of the connecting portion is smaller than the width of both the chest portion and the abdominal portion.

In another illustrative embodiment, a personal flotation device includes a chest portion having a top region and a bottom region, an abdominal portion, and a connecting portion positioned between the bottom region of the chest portion and the abdominal portion. The chest portion, abdominal portion and connecting portion are arranged to together form a generally I-shape.

In yet another embodiment, a personal flotation device includes an inflatable bladder having a chest portion with a top region and a bottom region, an abdominal portion, and a connecting portion positioned between the bottom region of the chest portion and the abdominal portion. The connecting portion extends only from a center region of the chest portion, and the width of the connecting portion is smaller than the width of both the chest portion and the abdominal portion. The personal flotation device further includes a garment comprising a pocket arranged to removably secure the inflatable bladder to the garment, where the inflatable bladder is removably secured to the garment.

BRIEF DESCRIPTION OF DRAWINGS

In the drawings, each identical or nearly identical component that is illustrated in the various figures is represented by a like numeral. For purposes of clarity, not every component may be labeled in every drawing.

Various embodiments of the invention will now be described, by way of example, with reference to the accompanying drawings, in which.

DETAILED DESCRIPTION

Figure 1:
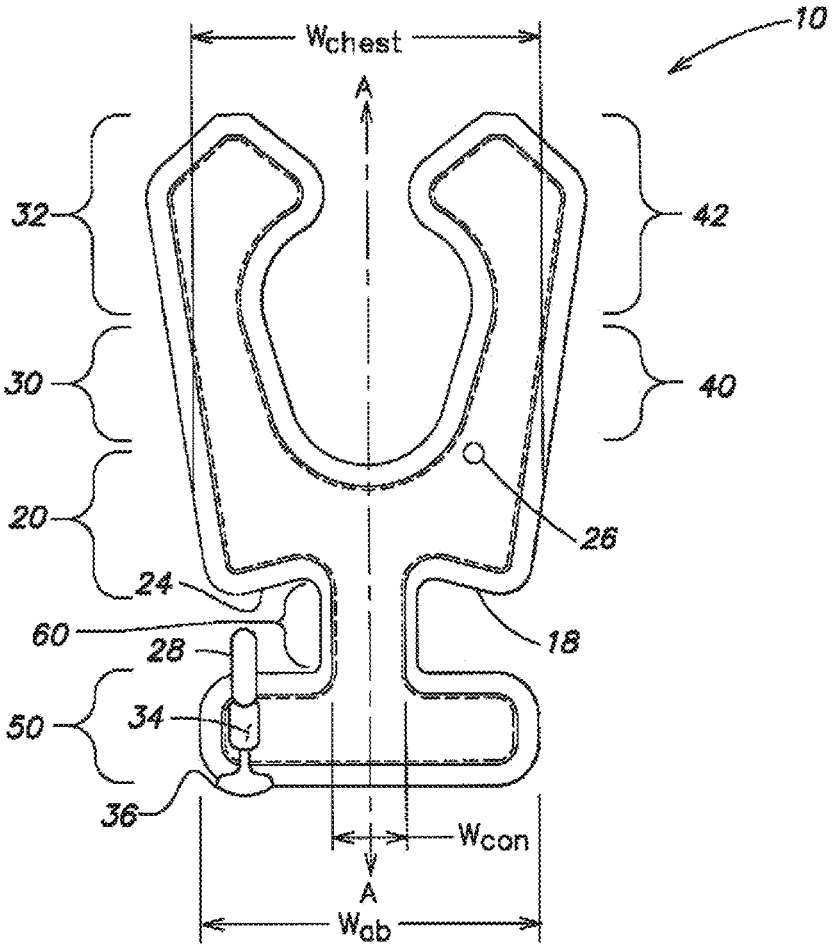
FIG. 1 illustrates a personal flotation device according to one embodiment.

The described embodiments are directed to a personal flotation device that provides buoyancy to a wearer. It should be appreciated that the personal flotation device may be configured in any of numerous ways, and that the present invention is not limited to the particular devices described below.

In one embodiment, the personal flotation device is formed with an inflatable bladder, whereas in another embodiment, the personal flotation device is formed with an inherently buoyant material, such as a foam or other low density material. In yet another embodiment, the personal flotation device may be formed with a combination of an inflatable bladder and an inherently buoyant material.

Turning now to the drawings, it should be appreciated that the drawings illustrate various components and features which may be incorporated into one or more embodiments of the present invention. For simplification, several drawings may illustrate more than one optional feature or component. However, the present invention is not limited to the specific embodiments disclosed in the drawings. It should be recognized that the present invention encompasses one or more embodiments which may include only a portion of the components illustrated in any one figure, and/or may also encompass one or more embodiments combining components illustrated in multiple different drawings, and/or may also encompass one or more embodiments not explicitly disclosed in the drawings.

FIG. 1 illustrates a personal flotation device 10 which is formed with a bladder, which is shown in an inflated position. As is conventional in apparel and other devices designed for wearing, portions of the personal flotation device are referenced with respect to parts of a wearer's body. The personal flotation device 10 includes a chest portion 20, an abdominal portion 50 and a connecting portion 60 extending between the chest portion 20 and the abdominal portion 50. The chest portion has a top region 22 and a bottom region 24 and the connecting portion 60 extends down from the bottom region 24 of the chest portion 20. As shown in FIG. 1, the connecting portion 60 may extend only from the center region of the chest portion 20.

As shown in FIG. 1, the personal flotation device 10 may be symmetric about a centerline A of the device 10. In another embodiment, the device 10 may be asymmetric about the centerline A, as the invention is not so limited. As also shown in FIG. 1, the bottom edge 18 of the chest portion 20 may be angled upwardly towards the centerline A.

In one embodiment, the chest portion 20 of the device 10 may be configured to be positioned directly below the collar bone of a wearer and above the lower pectorals. The chest portion 20 may be configured to be centered between a wearer's shoulders. However, it should be appreciated that the chest portion 20 may also be offset from the wearer's shoulders, as the invention is not so limited. The chest portion 20 provides buoyancy and may provide a level of rolling ability to turn a person into a face up position. The abdominal portion 50 may provide additional buoyancy and may lower the center of buoyancy of the bladder.

Figure 2:
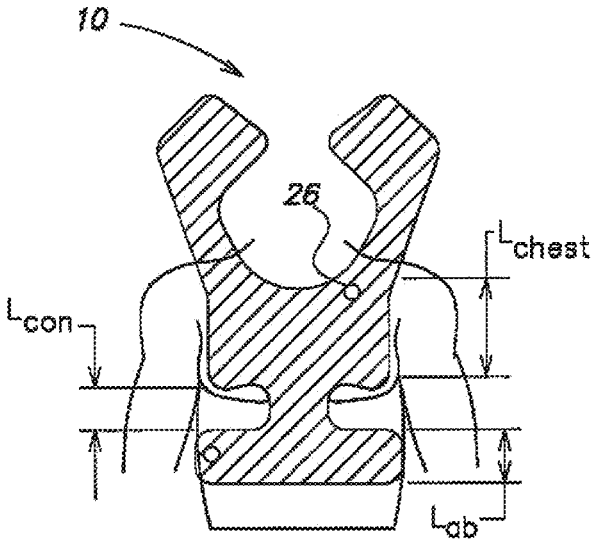
FIG. 2 illustrates the personal flotation device shown in FIG. 1 on a male wearer.
Figure 3:
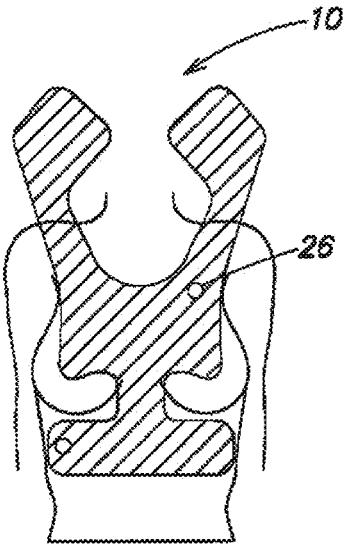
FIG. 3 illustrates the personal flotation device shown in FIG. 1 on a female wearer.

In one embodiment, the width $W_{con}$ of the connection portion is smaller than the widths $W_{chest}$ and $W_{ab}$ of each of the chest portion 20 and the abdominal portion 50. FIGS. 2 and 3 illustrated the inflated bladder shown in FIG. 1 being worn by both a male wearer and a female wearer, respectively. As illustrated, the connecting portion 60 may be constructed to be sufficiently narrow so that the flotation device 10 does not substantially overlie a wearer's ribcage and/or a wearer's breasts. The chest portion 20 of the device 10 may be positioned to extend along an upper portion of a wearer's chest. The more narrow connecting portion 60 may extend along and/or near the wearer's sternum, and the abdominal portion 50 may be positioned to extend along the wearer's abdomen. In one embodiment, the abdominal portion 50 may be configured to be substantially positioned below a wearer's ribcage and/or breasts.

It is contemplated that this unique design of the personal flotation device 10 may be more comfortable to the wearer by shaping the flotation device 10 in a manner to not substantially overlie a wearer's ribcage and/or a wearer's breasts. In one embodiment, the flotation device is constructed to avoid these more curved contours of the wearer's body. Curved contours of a wearer's body, such as a wearer's breasts, may be more sensitive, and it may be more comfortable to the wearer to minimize the contact between the flotation device 10 and these more sensitive areas. Other curved contours of a wearer's body, such as the ribcage, may expand and contract as the wearer breathes. It may be more comfortable to the wearer to minimize the contact between the flotation device and an area of the wearer that will expand.

The narrow connecting portion 60 also may make the flotation device 10 more flexible in comparison to a flotation device that does not have a narrow connecting portion 60. In particular, the narrow connecting portion 60 may provide a greater amount of torsional flex of the flotation device 10 which may enable the wearer to move more easily while wearing the flotation device 10. For example, the flexibility of the flotation device 10 may permit the wearer to have a wider range of motion. The narrow connecting portion 60 may also allow the flotation device to lay flat along the wearer's body and may minimize the amount of bulkiness, which may be more aesthetically pleasing to the wearer.

As discussed below, the width and length of the chest portion 20, abdominal portion 50 and connecting portion 60 may vary according to different embodiments of the present invention. In one embodiment, the ratio of the width $W_{con}$ of the connecting portion 50 to the width $W_{chest}$ of the chest portion 20 and/or the width $W_{ab}$ of the abdominal portion 50 is at least 1:2. In another embodiment the ratio of the width of the connecting portion 50 to the width of the chest portion 20 and/or the abdominal portion 50 is at least 1:3. In yet another embodiment, the ratio is at least 1:4, and in another embodiment, the ratio is at least 1:5.

In one embodiment, the chest portion 20 is configured to extend across a substantial portion of a wearer's chest and the width $W_{chest}$ of the chest portion 20 may vary from approximately 12 inches to approximately 16 inches. In one particular embodiment, the maximum width $W_{chest}$ of the chest portion is approximately 14 inches. In one embodiment, the chest portion 20 may be configured to be generally rectangular shaped. The side edges of the chest portion 20 may be angled such that the width $W_{chest}$ of the chest portion may vary along the length. For example, in one embodiment, the width $W_{chest}$ of the chest portion may taper from a maximum width $W_{chest}$ of the chest portion of approximately 14 inches at the top region 22 of the chest portion 20 down to a minimum width $W_{chest}$ of approximately 12 inches at the bottom region 24 of the chest portion 20.

Extending downwardly from the bottom region 24 of the chest portion 20 is the connecting portion 60 which has a width $W_{con}$ which is smaller than the $W_{chest}$. In one embodiment, the width $W_{chest}$ of the connecting portion 60 may vary from approximately 1 inch to approximately 5 inches. In one particular embodiment, the width $W_{chest}$ of the connecting portion is approximately 3 inches. In one embodiment, the connecting portion may be configured to be approximately rectangular shaped.

As mentioned above, the connecting portion 60 is positioned between the chest portion 20 and the abdominal portion 50. The abdominal portion 50 may also be configured to be generally rectangular shaped. In one embodiment, the width $W_{ab}$ of the abdominal portion is substantially the same as the width $W_{chest}$ of the chest portion. In one embodiment, the width $W_{ab}$ of the abdominal portion 50 may vary from approximately 12 inches to approximately 16 inches, and in one particular embodiment, the width $W_{ab}$ of the abdominal portion 50 is approximately 14 inches.

It should be appreciated that the present invention also contemplates embodiments where the width of the chest portion 20, connecting portion 60 and/or abdominal portion 50 are outside of the above-mentioned ranges, as the invention is not so limited.

The length of the chest portion 20, connecting portion 60 and abdominal portion 50 may also vary according to different embodiments of the present invention. In one embodiment, the length $L_{chest}$ of the chest portion 20 may vary from approximately 3 inches to approximately 6 inches. In one particular embodiment, the length $L_{chest}$ of the chest portion is approximately 4 inches. The length $L_{ab}$ of the abdominal portion 50 may vary from approximately 3 inches to approximately 6 inches. In one embodiment, the length $L_{ab}$ of the abdominal portion 50 is approximately 4 inches. The length $L_{on}$ of the connecting portion 60 may vary from approximately 3 inches to approximately 8 inches, and in one particular embodiment, the length $L_{con}$ of the connecting portion 60 is approximately 5 inches. In one embodiment, the length $L_{con}$ of the connecting portion 60 is greater than the length $L_{chest}$ of the chest portion or the length $L_{ab}$ of the abdominal portion 50. In another embodiment, the length of the connecting portion 60 may be approximately the same as the length of the chest portion 20 and/or the length of the abdominal portion 50.

As shown in FIGS. 1-3, in one embodiment, the chest portion 20, connecting portion 60 and abdominal portion 50 together form a generally I-shape, configured to not substantially overlie a wearer's ribcage and/or a wearer's breasts.

In one embodiment, the connecting portion 60 and the chest portion 20 and/or the connecting portion 60 and the abdominal portion 50 define an abrupt transition therebetween. For example, as shown in FIG. 1, the transition between the connecting portion 60 and the abdominal portion 50 is defined by an angle of approximately 90°. Also shown in FIG. 1, the transition between the connecting portion 60 and the chest portion 20 is defined by an angle of approximately 80°. In this embodiment, this angle between the connecting portion 60 and the chest portion 20 is affected by the amount the bottom region 24 is tapered upwardly toward the centerline A. In another embodiment where the bottom edge 18 tapers downwardly toward the centerline A, the transition between the connecting portion 60 and the chest portion 20 may be defined by an angle greater than 90°. In another embodiment, the abrupt transition may be defined by an angle of at least approximately 30°. In another embodiment, the abrupt transition region may be defined by an angle of at least approximately 45°, or at least approximately 60°. In a further embodiment, the abrupt transition region is defined by an angle of at least approximately 90°.

In the embodiment illustrated in FIGS. 1-3, the personal flotation device 10 further includes a first shoulder portion 30 and a second shoulder portion 40 each extending from the top region 22 of the chest portion 20 at spaced apart locations. The first shoulder portion 30 may include a back portion 32 configured to extend across at least a portion of a wearer's back and/or neck. It should be appreciated that FIGS. 1-3 illustrate a personal flotation device 10 formed with an inflatable bladder which is shown in a substantially flattened inflated position. It should be appreciated that when the bladder is worn on a wearer's body, the first and second shoulder portions 30, 40 may extend about the wearer's shoulder, and the back portion 32 may extend downwardly towards the wearer's shoulder blade. In one embodiment, the second shoulder portion 40 may also include a back portion 42 configured to extend across at least a portion of a wearer's back.

The first and second shoulder portions 30, 40 may provide additional buoyancy to the wearer to keep the wearer afloat. The shoulder portions 30, 40 and the back portion 32, 42 may also help to hold the wearer's body at an angle to keep the wearer's head above water.

In the particular embodiment illustrated in FIGS. 1-3, the two back portions 32, 42 are spaced apart. This configuration may make it easier for a wearer to fit the flotation device 10 over his/her head. In another embodiment which is discussed in greater detail below, the back portion 32 may be configured such that the first and second shoulder portions 30, 40 are continuous with each other at a location spaced apart from the chest portion 20.

As illustrated in FIGS. 1-3, the first shoulder portion 30, the chest portion 20 and the second shoulder portion 40 may be arranged to form an approximately U-shaped portion to fit around a wearer's neck. In one embodiment, the U-shape may extend into the two back portions 32, 42.

Figure 4:
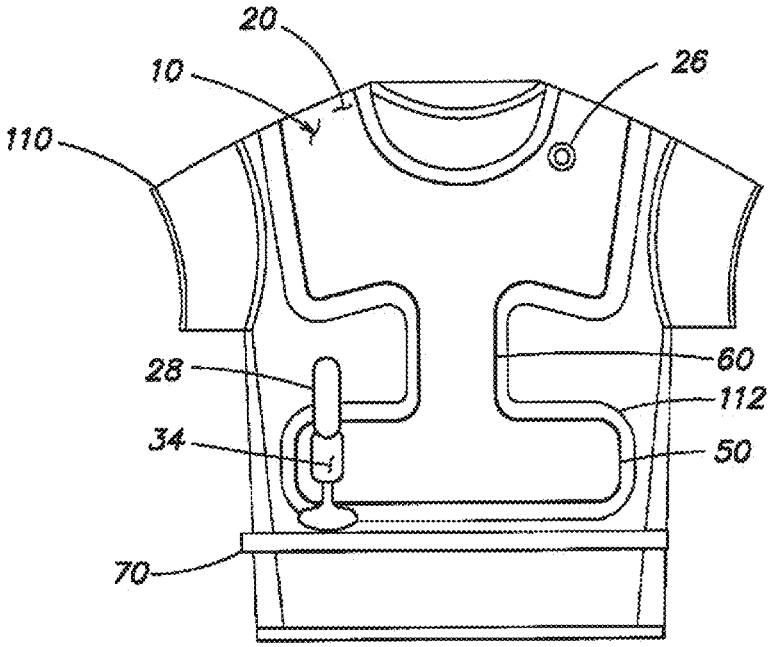
FIG. 4 is a front view of the personal flotation device shown in FIG. 1 secured to a garment according to one illustrative embodiment.
Figure 5:
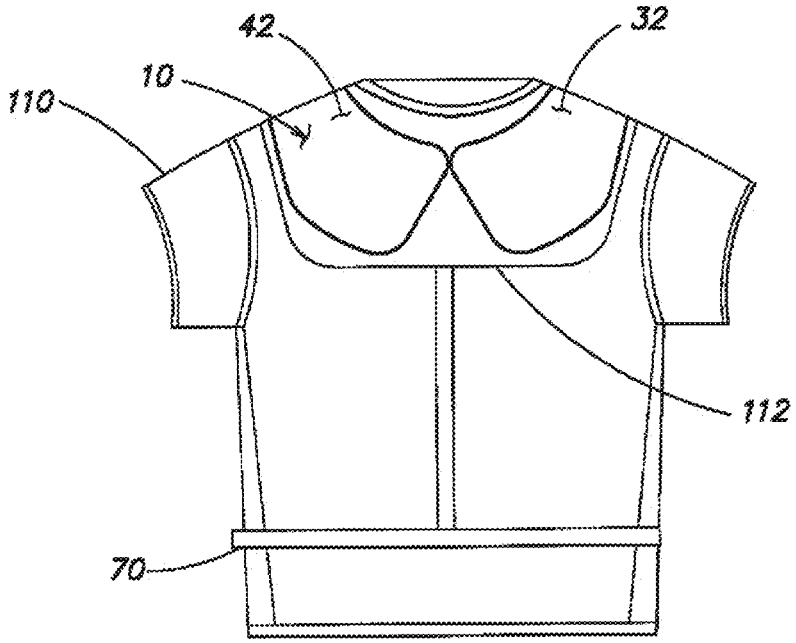
FIG. 5 is a rear view of the personal flotation device and garment illustrated in FIG. 4.
Figure 6:
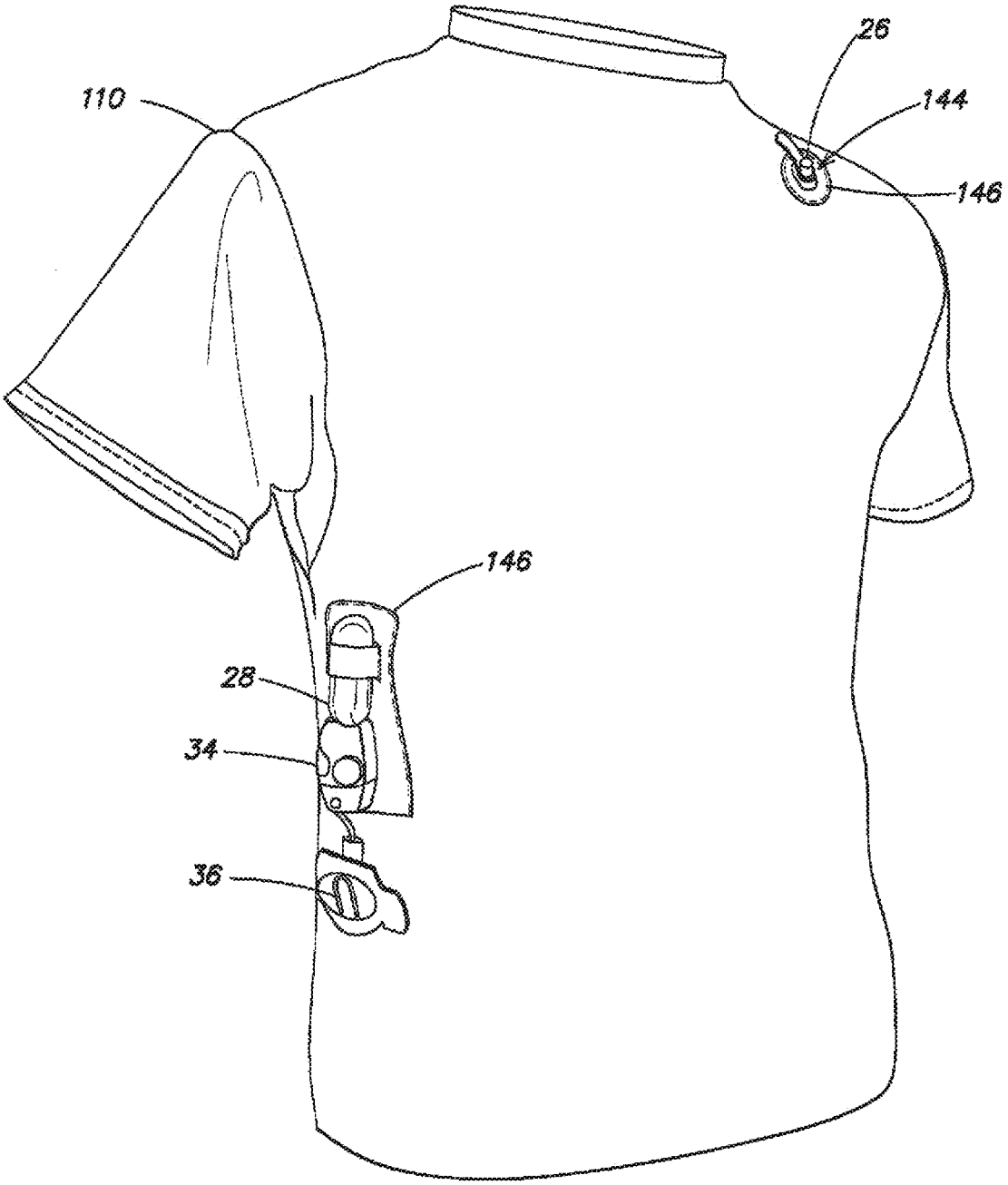
FIG. 6 is a perspective view of a personal flotation device and garment according to one illustrative embodiment.

Turning now to FIGS. 4-5, the personal flotation device 10 of the present invention in combination with a garment 110 will now be further discussed. In particular, FIGS. 4-5 illustrate a personal flotation device 10 secured to a garment 110. In this illustrative embodiment, the garment 110 is a rash guard that is configured to be put on over a wearer's head. It should be appreciated that in other embodiments, the garment 110 may be a jacket or vest or any other type of garment.

In one embodiment, the garment is made of an elastic material. In an embodiment where the personal flotation device 10 includes an inflatable bladder, the elastic garment material may stretch upon inflation of the bladder. In one embodiment, the garment 110 is designed to be a form-fitting garment 110. In embodiments where the bladder is positioned inside of the garment, the stretching of the garment 110 provides a space to accommodate the bladder as it is inflated. In embodiments where the garment is made from a form fitting elastic material, such as a rash guard, the garment may also assist in holding the bladder 10 against the wearer's body so that the bladder 10 will more readily conform to the wearer's body while being inflated. It is contemplated that the garment is made of spandex, LYCRA®, cotton, nylon, or polyester.

The flotation device 10 may be removably secured to the garment 110. In one illustrative embodiment, the garment 110 includes a liner 112 which forms a pocket arranged to removably secure the flotation device 10 to the garment 110. In one illustrative embodiment, the liner 112 is fixed to the garment 110 and is shaped to follow the outer contour of the flotation device 10. The liner 112 may be positioned on either the inside or the outside surface of the garment 110. In one embodiment, the liner 112 is made of a mesh material. The liner 112 may also be made of an elastic material or other fabric material as should be apparent to one of skill in the art.

As illustrated in FIG. 4, the personal flotation device 10 may include a strap 70 coupled to the device 10. The strap may be adjustable and may help to secure the device 10 to the wearer's body. The strap 70 may include a waist strap and may also include a vertical strap extending from the waist strap up to the flotation device. It should be appreciated that in one embodiment, the device 10 and strap 70 may be worn without the garment 110, whereas in another embodiment, the flotation device 10 and garment 110 may be worn without the strap 70, and in still another embodiment, the flotation device 10, strap 70 and garment 110 may all be worn together.

FIGS. 6-9 illustrate yet another embodiment of a personal flotation device 10 which is formed with an inflatable bladder which is secured to a garment 110. In this illustrative embodiment, the garment 110 has one or more openings 144 to enable an inflation mechanism 34 and/or an inflation tube 26, that extend from the inflatable bladder to be easily accessible by the wearer. In one embodiment, the garment 110 includes reinforcement sections 146 positioned around the openings 144 to provide additional support and cushioning and may also prevent the garment from tearing around the openings 144. In one embodiment, the reinforcement sections 146 are made of an elastic material, such as neoprene or rubber.

Figure 7:
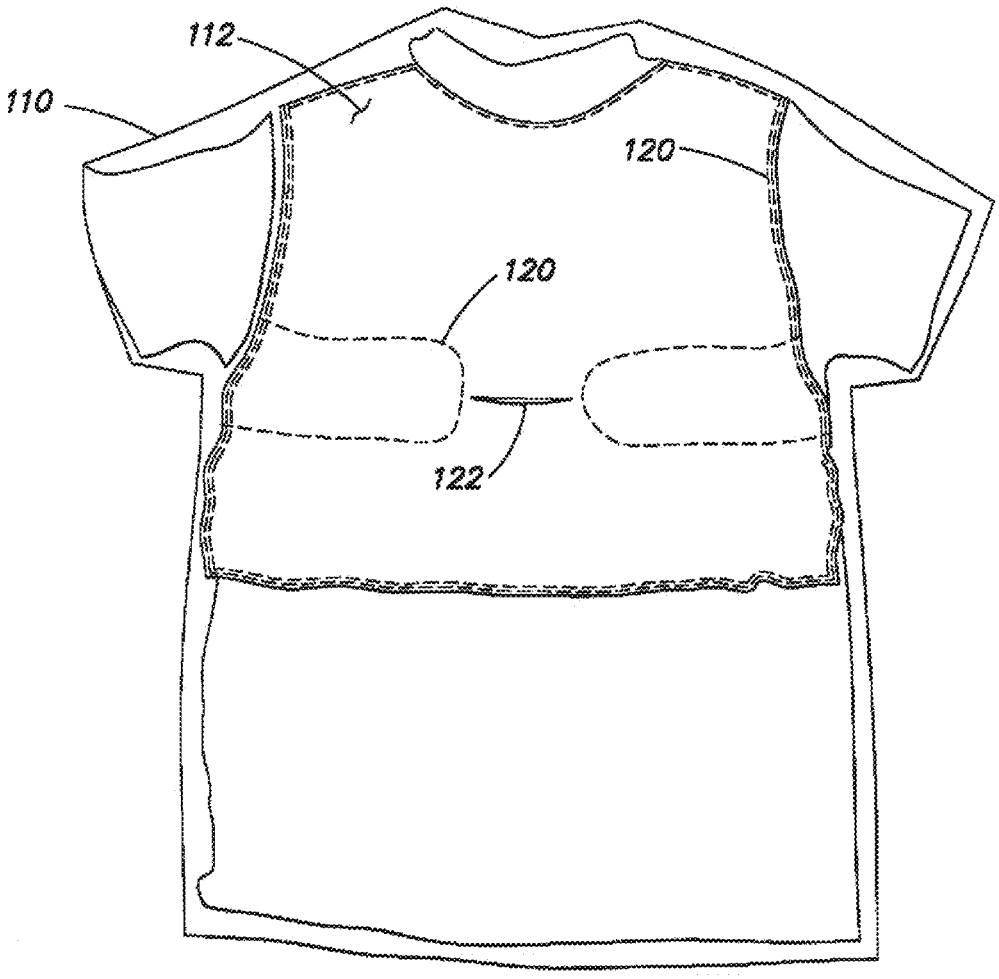
FIG. 7 is an inside-out front view of the garment shown in FIG. 6 illustrating a pocket to secure the flotation device to the garment.
Figure 8:
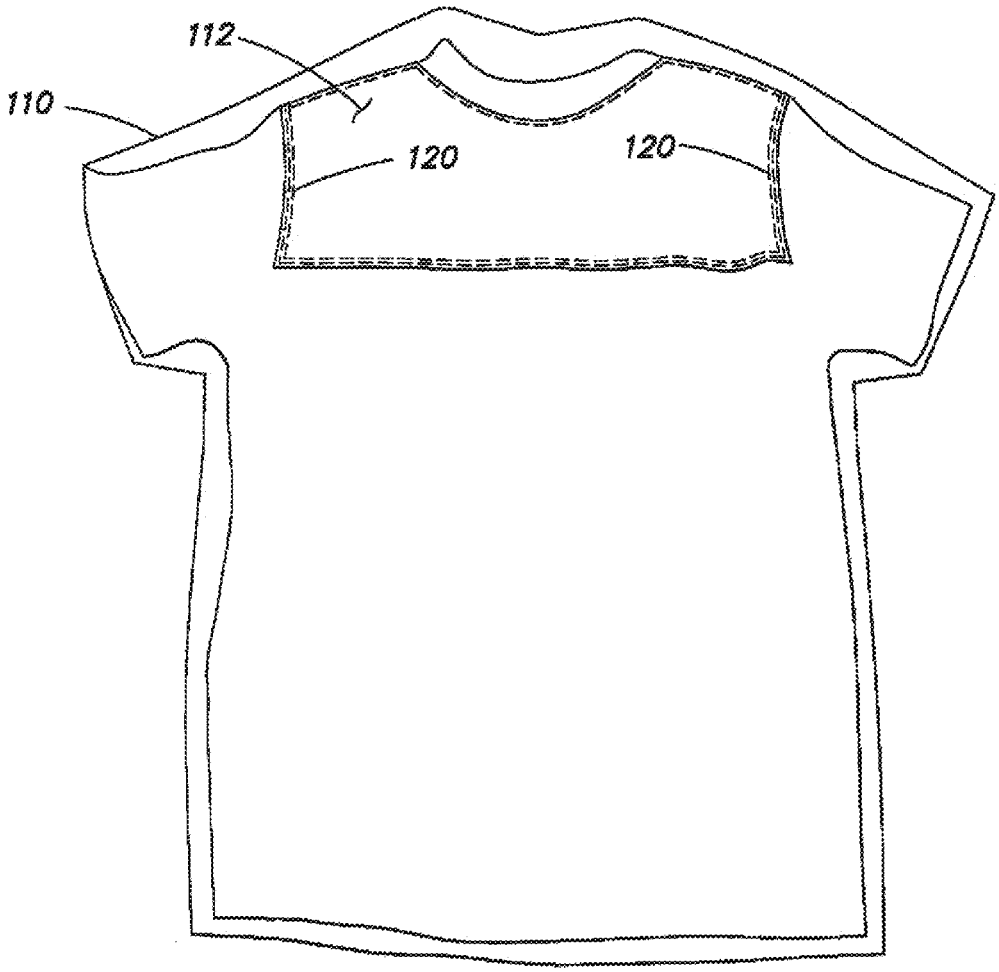
FIG. 8 is an inside-out rear view of the garment shown in FIG. 6.

FIGS. 7 and 8 are front and back views of the garment 110 shown inside-out to illustrate one embodiment of the liner 112. In this embodiment, the liner 112 is formed on the inside of the garment and forms a pocket for the inflatable bladder. In this embodiment, the liner 112 is secured to the garment with stitching 120 and the stitching 120 follows the outer contour of the bladder.

Figure 9:
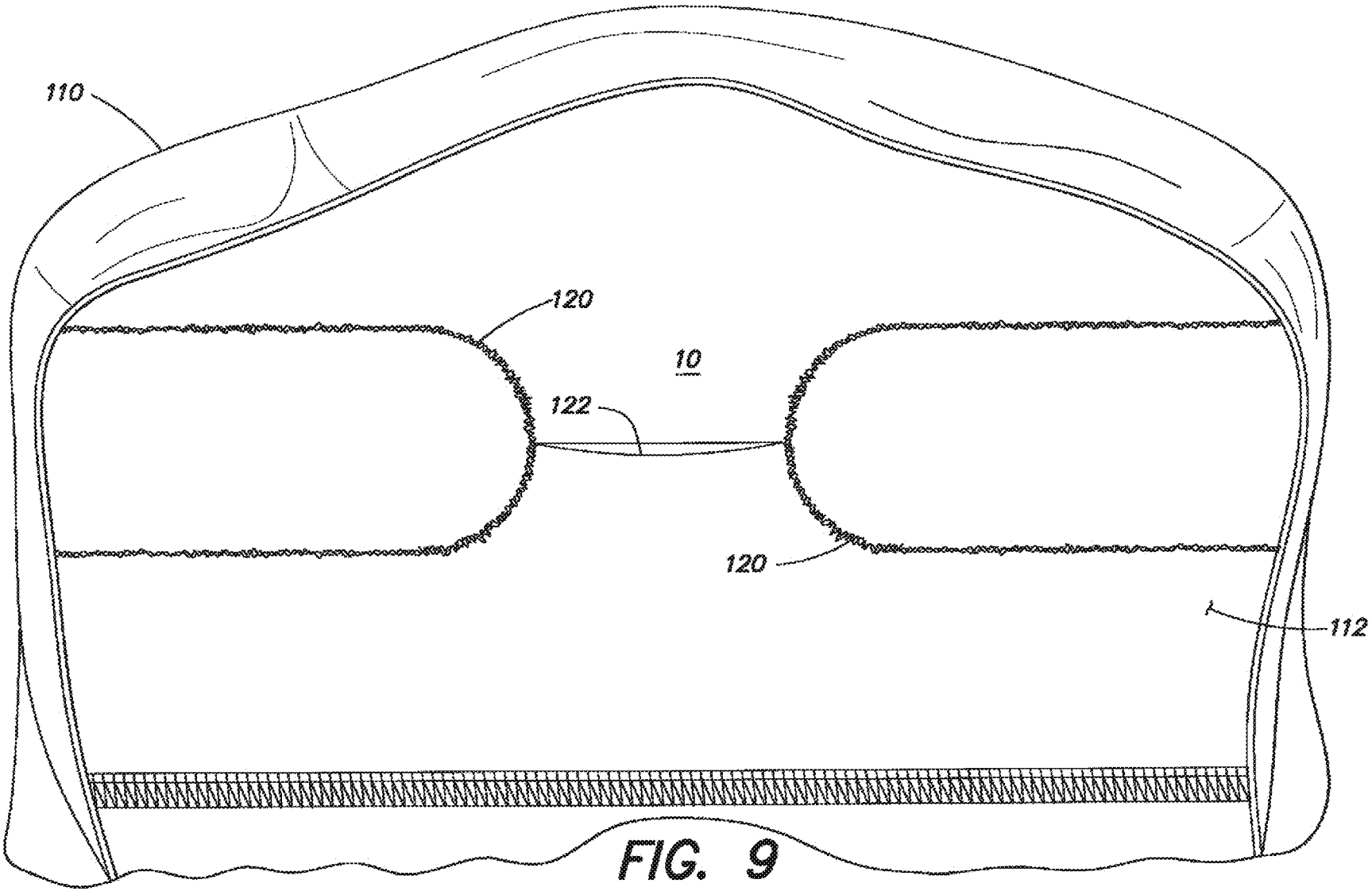
FIG. 9 is a detailed view of a portion of the pocket illustrated in FIG. 7.

In embodiments where the bladder is removably secured to the garment 110, the liner 112 may include one or more openings 122 so that the wearer may access the bladder and remove it when desired. In one embodiment, an opening 122 is located on the front side of the liner 112 in a location which aligns with the narrow connecting portion 60 of the bladder. In another embodiment as shown in FIG. 9, the opening 122 is located on the front side of the liner 112 on the side of the liner adjacent the garment 110. It should be appreciated that one or more openings 122 may be positioned in various locations on the liner 112 to provide access to the bladder 10 as the invention is not so limited.

Turning now to FIGS. 10A-10F, a personal flotation device according to various embodiments of the present invention are illustrated. In the embodiment shown in FIG. 10A, the flotation device 200 includes a chest portion 20, connecting portion 60 and abdominal portion 50. In this particular embodiment, these sections are split down the centerline A of the device to assist the wearer in placing the device 200 around his/her head. This embodiment also includes first and second shoulder portions 30, 40 which are coupled to each other with a back portion 32.

Figure 10A:
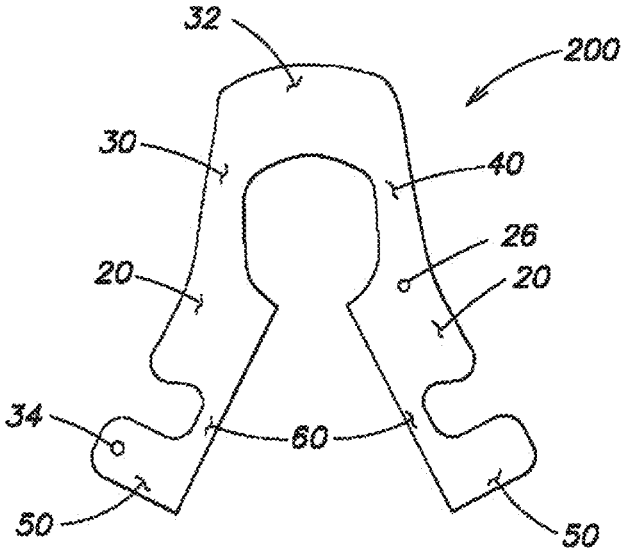
FIGS. 10A-10F illustrate the personal flotation device according to various embodiments of the present invention.
Figure 10B:
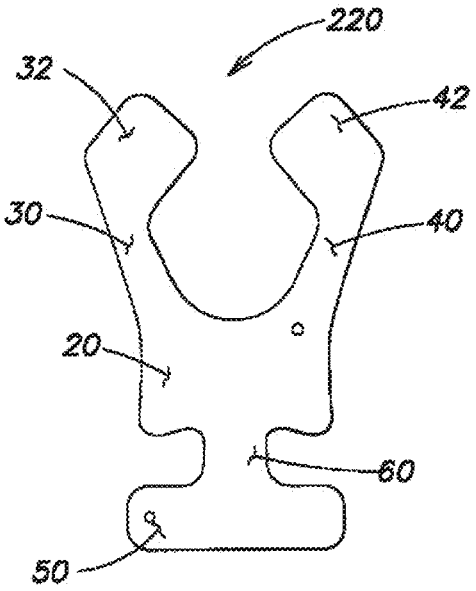

The embodiment illustrated in FIG. 10B includes a personal flotation device 220 that is substantially similar to the device 10 illustrated in FIG. 1.

Figure 10C:
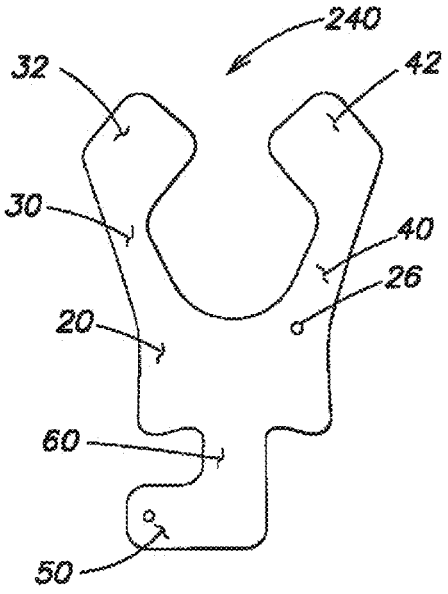

The flotation device 240 illustrated in FIG. 10C also includes a chest portion 20, connecting portion 60 and abdominal portion 50. In this particular embodiment, the width of the abdominal portion 50 is smaller than the embodiment shown in FIG. 10B, but, the width of the abdominal portion 50 is greater than the width of the connecting portion 60.

Figure 10D:
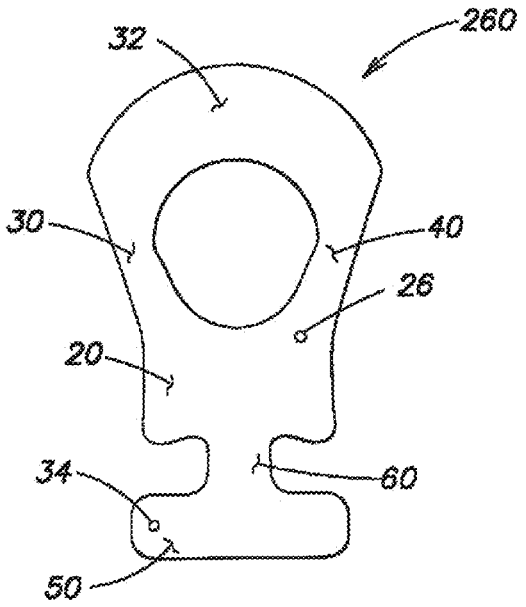

The flotation device 260 illustrated in FIG. 10D also includes a chest portion 20, connecting portion 60 and abdominal portion 50 with first and second should portions 30, 40 extending from the chest portion 20. In this embodiment, the first and second shoulder portions 30, 40 are continuous with each other through back portion 32.

Figure 10E:
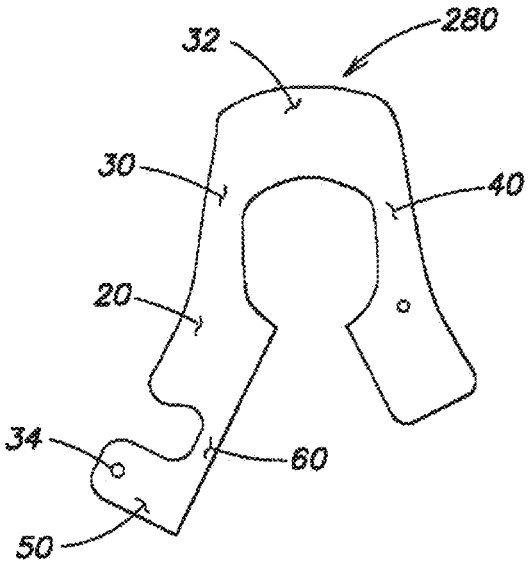

Turning now to FIG. 10E, yet another embodiment of a personal flotation device 280 is shown. In this embodiment, the chest portion 20, connecting portion 60 and abdominal portion 50 are split down the centerline to assist the wearer in placing the device 280 around his/her head. This embodiment also includes first and second shoulder portions 30, 40 that are continuous with each other through back portion 32.

Figure 10F:
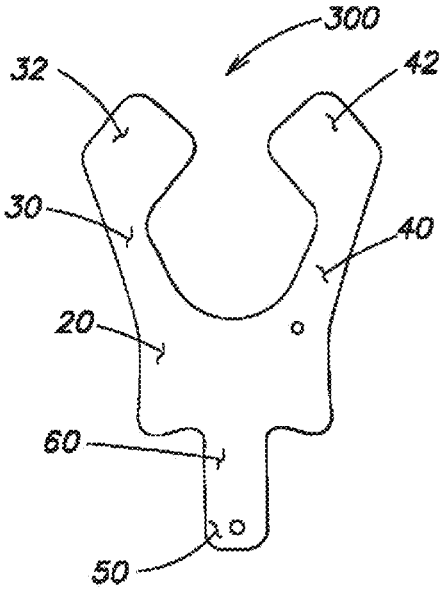

FIG. 10F illustrates another embodiment of a personal flotation device 300 which includes a chest portion 20, an abdominal portion 50 and a connecting portion 60. As illustrated, the width of the connecting portion is substantially equal to the width of the abdominal portion, and the width of the connecting portion 60 is smaller than the width of the chest portion 20. In this embodiment, the narrow connecting portion 60 extends from the bottom region of the chest portion 20 defining an abrupt transition therebetween. The angle between the chest portion 20 and the connecting portion 60 is approximately 90°. This device 300 also includes first and second shoulder portions 30, 40 which extend from the chest portion 20 and each shoulder portion 30, 40 includes a back portion 32, 42 configured to extend across at least a portion of a wearer's back.

As mentioned above, the personal flotation device 10 may be formed with an inflatable bladder. The bladder may be formed with two layers of material that are sealed around their perimeter to define a sealed chamber within. The bladder may be sealed in a variety of ways as the invention is not so limited. For example, the bladder may be sealed by radio frequency welding, ultrasonic welding and/or an adhesive.

As also mentioned above, the personal flotation device 10 may be formed with an inherently buoyant material, including, but not limited to, various foamed materials and other low density materials. Also as previously discussed, the personal flotation device may be formed with a combination of an inflatable bladder and an inherently buoyant material.

Certain prior inflatable bladders are made of a relatively inelastic material, such as a coated fabric, like a urethane coated nylon fabric. With these prior inflatable bladders, as the bladder is inflated, the volume within the bladder may expand from a collapsed configuration into an inflated configuration, but the material forming the bladder does not materially expand. In particular, the nylon fabric may restrict the expansion of the bladder material. The personal flotation device may be made of a relatively inelastic material, such as a urethane coated nylon fabric.

Alternatively, the bladder is made of an elastic material that stretches like a balloon, such that the material forming the bladder may materially expand as the bladder is inflated. The use of elastic materials to form the inflatable bladder may have numerous advantages. First, the use of an elastic material to form the bladder may allow the bladder to more readily conform to the shape of the wearer when inflated. In particular, the use of an elastic bladder material may allow portions of the bladder to stretch relative to other portions of the bladder. For example, as the bladder is inflated between the wearer's body and the garment 110, the chest portion 20 may stretch more than the abdominal portion 50. This stretching of one portion of a bladder relative to another portion of the bladder may permit the size of the bladder to adjust to the specific wearer's body. For example, if the wearer has a large chest in comparison to their abdomen, due to the amount of space between the wearer's body and the garment, the abdominal portion 50 of the bladder may stretch more than the chest portion 20. Similarly, if the wearer's abdomen is larger than their chest, the chest portion 20 of the bladder may stretch more than the abdominal portion 50.

Second, the use of an elastic material may allow the bladder to be made smaller than when a relatively inelastic material is used. This may be advantageous where the smaller bladder is less cumbersome to wear when the bladder is in a deflated position against the wearer.

Representative elastic bladder materials include, but are not limited to, blown urethane, rolled urethane, polyurethane, rubber, or silicone. In one particular embodiment, the bladder 10 is formed with a rolled urethane having a thickness of approximately 10 mil (0.009 inches), known as Urethane ST-1880, obtained from Stevens Urethane of Easthampton, Mass.

Applicant tested the elasticity of the rolled urethane and a prior bladder material, urethane coated nylon. In particular, the urethane coated nylon was a polyurethane material known as EREZ TPU 1001 T, which has a thickness of approximately 0.012 inches, and is available from Erez Thermoplastic Products with a US headquarters in Newport, R.I. The percent elongations of these two materials were tested according to ASTM D412 Elasticity Test with a constant rate tensile load apparatus. The test results are shown in the table below:

| | Rolled Urethane | Urethane Coated Nylon |
|---|---|---|
| First Test | 324.2% | 48.5% |
| Second Test | 257.6% | 51.5% |
| Third Test | 257.6% | 51.3% |
| Average | 242.4% | 50.4% |

As shown above, the percent elongation of the rolled urethane was over 4 times greater than that of the prior bladder material, the urethane coated nylon.

It should be appreciated that not all embodiments of the present invention include an inflatable bladder formed with an elastic material. It is also contemplated for one embodiment of the present invention to have bladders formed with relatively inelastic materials, such as, but not limited to coated fabrics.

It should also be appreciated that in one embodiment, the flotation device 10 may include only one continuous bladder which forms the various portions (chest portion 20, connecting portion 60 and abdominal portion, etc.) of the bladder. In this embodiment, the chest portion 20 may be fluidly coupled to the connecting portion 60 and/or the abdominal portion 50. However, the invention is not limited in this respect. In another embodiment, the flotation device 10 may include a plurality of separate bladders. For example, in one embodiment, a first bladder may form the chest portion 20 and a second bladder may form the abdominal portion 50 and a third bladder may form the connecting portion 60.

The inflatable bladder may include one or more manual inflation devices, one or more automatic inflation devices, or a hybrid of both manual and automatic inflation devices. A manual oral inflation tube/valve 26 may be provided, as may be a compressed gas cartridge 28 containing carbon dioxide, air, nitrogen, oxygen or the like that is arranged to release the pressurized gas into the bladder 20 once the cartridge 28 is manually pierced or triggered by an inflation mechanism 34, which may include a ripcord 36 or a button to activate. In one illustrative embodiment, the inflation mechanism 34 is located in the abdominal portion 50. The inflation mechanism 34 may be located in a position offset from the centerline A of the device 10 so that the mechanism 34 minimally interferes with the wearer's movements. In one embodiment, after a gas cartridge has been used, the bladder may be rearmed with another cartridge and may be reused multiple times.

The cartridge may include an automated form of inflation that includes a water-soluble capsule, a dissolving disk, and/or a hydrostatic pressure sensitive inflator. The dissolving disk will disintegrate upon submersion into water, triggering puncture of the cartridge 28 and leading to the release of the pressurized gas into the bladder. The hydrostatic inflator may be activated upon reaching a pressure change that may occur when the inflator is submerged under water. The automated form of inflation may be desirable if the wearer becomes incapable of initiating inflation of the bladder.

The bladder may be inflated to a variety of different buoyancy levels, as the invention is not limited in this respect. In one embodiment, the flotation device may be configured for use as a buoyancy aid and may be configured to provide between approximately 6 lbs-approximately 9 lbs of force. In one embodiment, the bladder may be used with small gas cartridges 28 holding approximately 8-10 lbs of force. During a water activity, if the wearer begins to feel tired, the wearer may orally inflate the device with tube 26. If only a small amount of buoyancy is needed, the wearer may only partially inflate the device. The bladder may then be deflated with the oral inflation tube/valve 26.

In one embodiment, the flotation device is used to provide functional buoyancy, which is known as providing a level of buoyancy which may provide a certain amount of lift and turning performance in the water, but may not provide enough buoyancy to act as a life saving device, which typically requires approximately 22.5 lbs of force. In another embodiment, it is contemplated that the device 10 may provide enough buoyancy when inflated to act as a life saving device.

The personal flotation device may be configured for use while a wearer is engaged in a variety of water sports, such as, but not limited to, kayaking, swimming, surfing, rowing, water polo, water skiing and triathlons. In one embodiment, the personal flotation device is configured to be worn during active water sports and the device is configured to minimize the amount of bulging, overlapping, rubbing and chaffing that may be caused by the device.

In one embodiment, the flotation device may be configured for use as a buoyancy aid. A buoyancy aid is a type of a personal flotation device that provides less buoyancy in comparison to a life-saving device. In one embodiment, the flotation device 10 is configured as a buoyancy aid and provides between approximately 6 lbs-approximately 9 lbs of force. In one embodiment, the flotation device may be configured to provide between approximately 7 lbs-approximately 22.5 lbs of force. In one embodiment, the flotation device 10 is configured as a buoyancy aid and provides at least approximately 50 Newtons (~11.24 lbs of force). This is the minimum standard in the European Union for a device to be certified as a buoyancy aid. In another embodiment, the flotation device 10 is configured as a buoyancy aid and provides at least approximately 22.5 lbs of force (~100 Newtons). This is the minimum standard for a buoyancy device to be approved by the United States Coast Guard as a Type III Inflatable Flotation Aid. It should be appreciated that in other embodiments, the flotation device may be configured to be more or less buoyant than the above-mentioned examples, as the invention is not so limited.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A personal flotation device, comprising:

a chest portion having a top region and a bottom region, wherein a bottom edge of the chest portion angles upwardly toward a centerline of the device;

a shoulder portion extending from the top region of the chest portion and arranged to extend across at least a portion of the wearer's neck;

an abdominal portion having a width arranged to extend only partially around a wearer's body; and a connecting portion positioned between the bottom region of the chest portion and the abdominal portion and extending only from a center region of the chest portion, wherein the width of the connecting portion is smaller than the width of both the chest portion and the abdominal portion, wherein the connecting portion is configured in a manner to extend along a wearer's sternum such that at least a portion of the connecting portion does not overlie a wearer's ribs, wherein the width of the connecting portion is between approximately 1-5 inches, and the ratio of the width of the connecting portion to the width of the chest portion is at least approximately 1:3;

wherein the chest portion, the shoulder portion, the abdominal portion and the connecting portion are each configured to be buoyant.

2. The personal flotation device of claim 1,
wherein the shoulder portion includes a first shoulder portion and a second shoulder portion each extending from the chest portion.

3. The personal flotation device of claim 2, wherein the first shoulder portion, chest portion and second shoulder portion are constructed and arranged to form an approximately U-shaped portion to fit around a wearer's neck.

4. The personal flotation device of claim 1, wherein the ratio of the width of the connecting portion to the width of the abdominal portion is at least approximately 1:3.

5. The personal flotation device of claim 1, wherein the chest portion, the abdominal portion and the connecting portion are formed with an inflatable bladder, and the inflatable bladder is formed with two layers of material that are sealed around a perimeter.

6. The personal flotation device of claim 1, wherein there is an abrupt transition between the connecting portion and the chest portion.

7. The personal flotation device of claim 1, wherein the chest portion, abdominal portion and connecting portion are constructed and arranged to together form an approximately I-shaped portion.

8. The personal flotation device of claim 1, wherein at least one of the chest portion, the abdominal portion and the connecting portion is formed with an inflatable bladder.

9. The personal flotation device of claim 8, further comprising a device for inflating the bladder.

10. The personal flotation device of claim 9, wherein the device for inflating the bladder includes a compressed gas cartridge.

11. The personal flotation device of claim 8, wherein the bladder is made of an elastic material that stretches upon inflation of the bladder.

12. A combination comprising:
the personal flotation device recited in claim 1; and
a garment, wherein the personal flotation device is secured to the garment.

13. The combination of claim 12, wherein the personal flotation device is removably secured to the garment.

14. The combination of claim 13, wherein the garment further comprises a pocket constructed and arranged to removably secure the personal flotation device to the garment.

15. The combination of claim 12, wherein at least one of the chest portion, the abdominal portion and the connecting portion is formed with an inflatable bladder, and wherein the garment is made of an elastic material that stretches upon inflation of the bladder.

* * * * *